US006527601B2

(12) United States Patent
Chen

(10) Patent No.: US 6,527,601 B2
(45) Date of Patent: Mar. 4, 2003

(54) FEMALE TERMINAL

(75) Inventor: Ping Chen, West Bloom Field, MI (US)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/022,110

(22) Filed: Dec. 13, 2001

(65) Prior Publication Data

US 2002/0076999 A1 Jun. 20, 2002

(30) Foreign Application Priority Data

Dec. 18, 2000 (JP) ..... 2000-384452

(51) Int. Cl.[7] ..... H01R 11/22
(52) U.S. Cl. ..... 439/852; 439/851
(58) Field of Search ..... 439/851, 852, 439/862, 816, 856, 857, 858, 861, 849, 850, 854, 853

(56) References Cited

U.S. PATENT DOCUMENTS

| | | | | |
|---|---|---|---|---|
| 3,836,947 A | | 9/1974 | Yeager | |
| 5,188,545 A | | 2/1993 | Hass et al. | |
| 5,443,592 A | | 8/1995 | Ittah et al. | |
| 5,562,501 A | * | 10/1996 | Kinoshita et al. | 439/852 |
| 5,643,018 A | * | 7/1997 | Sakai et al. | 439/852 |
| 5,741,163 A | | 4/1998 | Hotea | |
| 5,941,741 A | | 8/1999 | Dobbelaere et al. | |
| 6,042,433 A | | 3/2000 | Chen | |
| 6,152,788 A | * | 11/2000 | Hata et al. | 439/852 |
| 6,227,915 B1 | | 5/2001 | Sakatani et al. | |
| 6,290,553 B1 | * | 9/2001 | Sato et al. | 439/843 |

FOREIGN PATENT DOCUMENTS

| | | |
|---|---|---|
| JP | 09147950 | 6/1997 |
| JP | 2000353562 | 12/2000 |

OTHER PUBLICATIONS

"Female Crimp Terminal", by Ping Chen. U. S. patent application 10/022,111; Dec. 13, 2001; pp. 1 to 12 and 5 sheets of drawings.

* cited by examiner

*Primary Examiner*—Renee Luebke
*Assistant Examiner*—Phvongchi Nguyen
(74) *Attorney, Agent, or Firm*—W. F. Fasse; W. G. Fasse

(57) ABSTRACT

A female terminal includes: a tubular body; a leaf spring inside the body having a first bent part bent upward and rearward from the front end of the bottom wall of the body, an intermediate part extending rearward from the first bent part, a second bent part bent downward and forward from the rear end of the intermediate part, and a top end part extending forward from the second bent part and spaced away from the intermediate part; a first fitting means for fitting the front end of the top end part onto the side walls; a second fitting means, which allows the intermediate part to be displaced downward to contact the top end part of the leaf spring, and a part ahead thereof to be displaced downward until the intermediate part fits onto the side walls at the bottom dead point; and a flexible-piece-receiving hole in the bottom wall ahead of a part at which the leaf spring will contact the bottom wall.

19 Claims, 9 Drawing Sheets

FEMALE TERMINAL

CROSS-REFERENCE TO RELATED APPLICATION

This application is related to my copending U.S. patent application Ser. No. 10/022,111, filed on Dec. 13, 2001.

BACKGROUND OF THE INVENTION

1. Field of the Invention

The present invention belongs to a technical field of female terminals to be fitted in a housing of a female connector, and relates to improvement of a female terminal, which has a leaf spring for contacting a male terminal, said leaf spring being provided inside a tubular body thereof.

2. Related Art

A female terminal is known, which comprises a tubular body into which a male terminal is inserted through a front opening thereof and a leaf spring being provided inside the body. In the case of the female terminal that is disclosed by Japanese Patent unexamined publication gazette Heisei 9-147950, the body has a bottom wall, side walls that are provided on both ends of the bottom wall in its width direction to oppose to each other, and upper walls that are provided on the side walls on their upper side to oppose to the bottom wall. The leaf spring has a first bent part that is integrally provided on the front end of the bottom wall of the body and bends upward and rearward, an intermediate part that extends rearward from the first bent part, a second bent part that bends downward and forward from the rear end of the intermediate part, and a top end part that extends forward from the second bent part, keeps itself away from the intermediate part and contacts the bottom wall of the body by the front end thereof. Furthermore, this female terminal has a first rising piece that rises from the bottom wall of the body and a second rising piece that rises from the front end of the top end part of the leaf spring. In the case of this female terminal, when a male terminal is inserted through the front opening of the body into a regular position, the front end of the top end part will contact the bottom wall, and the leaf spring will exhibit its elastic restoring force for an elastic range between the front end of the top end part and the first bent part to generate an adequate contact force between itself and the male terminal. If the male terminal is inserted with a slight tilt away from the regular position, the leaf spring will be subjected to a prying force or the like, and the entirety of the top end part thereof will contact the bottom wall. As a result, of the leaf spring, only the intermediate part will function as an elastic range, and the leaf spring will show a higher rigidity, preventing its excessive deformation. If the prying force or the like gets greater, the intermediate part will come into contact with the first rising piece and the second rising piece successively, and the leaf spring will be prevented from further excessive deformation.

When a female terminal is to be fitted into a housing, a cell of the housing is provided with a flexible piece having flexibility, and this flexible piece will be fitted onto the female terminal. There are two modes for this fitting. In a first mode, a flexible piece is made to fit into a flexible-piece-receiving hole that is opened in the bottom wall of the female terminal. In the second mode, a flexible piece is fitted onto the rear end of the upper wall of the body. In the case of the female terminal described above, the first mode wherein a flexible-piece-receiving hole is opened in the bottom wall can not be adopted and the second mode must be adopted, because the top end part of the leaf spring must be supported by the bottom wall and a part from which the first rising piece is to be cut and raised must be secured in the bottom wall. This, however, makes it inevitable that when the flexible piece is to be disengaged from the female terminal by means of a precision screwdriver or the like, one has to lift the flexible piece by inserting the precision screwdriver or the like deep into the cell. This work can not be done under visual observation. One has to rely on his or her hunch, and the workablility is very low.

SUMMARY OF THE INVENTION

The present invention was made in view of the above-mentioned points, and one objective of the invention is to secure an adequate contact force between the leaf spring and a male terminal, prevent excessive deformation of the leaf spring, make it possible to open a flexible-piece-receiving hole in the bottom wall and improve the workability of the work of disengaging a flexible piece from the female terminal, by fitting the front end of the top end part and the intermediate part of the leaf spring onto the side walls.

To accomplish the above-mentioned objective, the female terminal of the present invention comprises a tubular body having a bottom wall, side walls provided on both ends of the bottom wall in the width direction to oppose to each other and an upper wall provided on the upper side of the side wall to oppose to the bottom wall, into which a male terminal is inserted through a front opening thereof, a leaf spring being provided inside the body and having a first bent part being integrally provided on the front end of the bottom wall of the body and being bent upward and rearward, an intermediate part extending rearward from the first bent part, a second bent part being bent downward and forward from the rear end of the intermediate part, and a top end part extending forward from the second bent part and keeping itself away from the intermediate part, a first fitting means for fitting the front end of the top end part of the leaf spring onto the side walls, a second fitting means, which allows, when the intermediate part of the leaf spring is displaced downward to contact the top end part of the leaf spring, a part ahead of said contacting part of the intermediate part of the leaf spring to be displaced downward by a certain length, and fits the part onto the side walls at the bottom dead point, and a flexible-piece-receiving hole being opened in the bottom wall ahead of a part at which the second bent part or the rear end of the top end part of the leaf spring being displaced downward contacts the bottom wall.

In the case of this female terminal, when it is inserted into a cell of a housing, a flexible piece will fit into the flexible-piece-receiving hole to fit the female terminal in the housing. If a male terminal is inserted through the front opening of the body, as the front end of the top end part of the leaf spring is fitted onto the side walls by the first fitting means, when the male terminal is inserted between the upper wall and the leaf spring and comes to the regular position, the leaf spring will exhibit its elastic restoring force for its elastic range between the front end of the top end part and the first bent part to provide an appropriate contact force between the male terminal and the leaf spring. If a prying force or the like acts, the second bent part of the leaf spring or the rear end of the top end part thereof will be displaced downward to contact the bottom wall, and in turn, the leaf spring will exhibit an elastic restoring force for an elastic range of only the intermediate part to balance the prying force or the like and prevent the leaf spring from excessive deformation. If the prying force or the like gets greater, the intermediate part of the leaf spring will be displaced downward to contact the top end part of the leaf spring, and in turn, the prying force or the like will be balanced by this contact and the leaf spring will be prevented from excessive deformation. If the prying force or the like increases much more, a part of the intermediate part ahead of the above-mentioned contact part of the intermediate part of the leaf spring will be displaced downward, and it will be stopped at a bottom dead point and fitted onto the side walls by the second fitting means. The prying force or the like will be balanced by this and the leaf spring will be prevented from excessive deformation. In this way, the prying force or the like is balanced in three stages to prevent the leaf spring from being deformed excessively.

In this case, as the front end of the top end part of the leaf spring is fitted onto the side walls by the first fitting means, the part of the leaf spring to contact the bottom wall is the second bent part or the rear end of the top end part, in other words, a part around the rear end of the leaf spring. Moreover, as the intermediate part of the leaf spring is fitted onto the side walls by the second fitting means, a rising piece that was explained in the related art is not needed, and in turn, there is no need of securing a part, in the bottom wall, from which the rising piece is cut and raised. With these arrangements, a flexible-piece-receiving hole can be opened in the bottom wall between the first bent part of the leaf spring and the part the second bent part or the rear end of the top end part of the leaf spring contacts when it is displaced downward. As a result of this, the operation of disengaging the flexible piece from the female terminal can be done near the front end of the body. As the operation can be done under visual observation, the workability is improved. Moreover, as there is a space beneath the intermediate part of the leaf spring between the first bent part and the front end of the top end part, the height of the female terminal can be kept low by accommodating the flexible piece in this space. As a result, the female terminal can be compactified. Moreover, costs can be reduced through common use of metal molds for this female terminal and a female terminal without any flexible-piece-receiving hole made in the bottom wall thereof. Further, the elimination of the conventional rising pieces results in a more compact development of the female terminal, reduced number of bending processes, a reduced course of production, and improved precision of working.

To sum up, in the female terminal of the present invention the front end of the top end part of the leaf spring and a part of the intermediate part of the leaf spring ahead of the contact part of the intermediate part are fitted onto the side walls. As a result, the female terminal of the present invention provides an appropriate contact force between itself and a male terminal, prevents the leaf spring from being deformed excessively, enables opening a flexible-piece-receiving hole in the bottom wall, and in turn, allows operation of disengaging the flexible piece from the female terminal near the front end of the body, enables the operation under visual observation, and enhances the workability. Moreover, as the flexible piece can be accommodated in a space beneath the intermediate part of the leaf spring between the first bent part and the front end of the top end part, the female terminal can be compactified. Furthermore, through the common use of metal molds with a female terminal having no flexible-piece-receiving hole in the bottom wall, the costs can be reduced. Elimination of the conventional rising pieces results in a more compact development of the female terminal, a reduced number of bending processes, a shorter production process, and an improved accuracy of working.

DESCRIPTION OF PREFERRED EMBODIMENTS OF THE INVENTION

Figure 1:
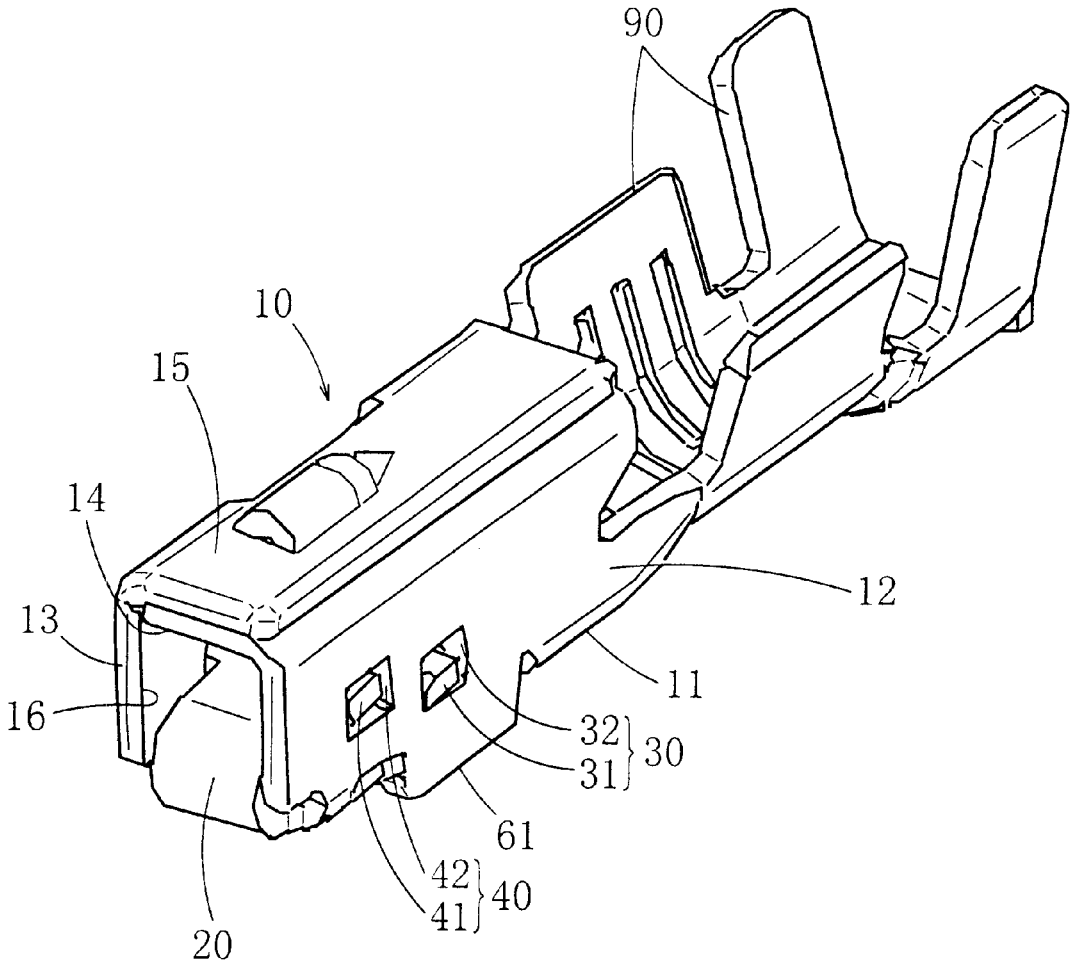
FIG. 1 is a perspective view of the female terminal of the first embodiment of the present invention.
Figure 2:
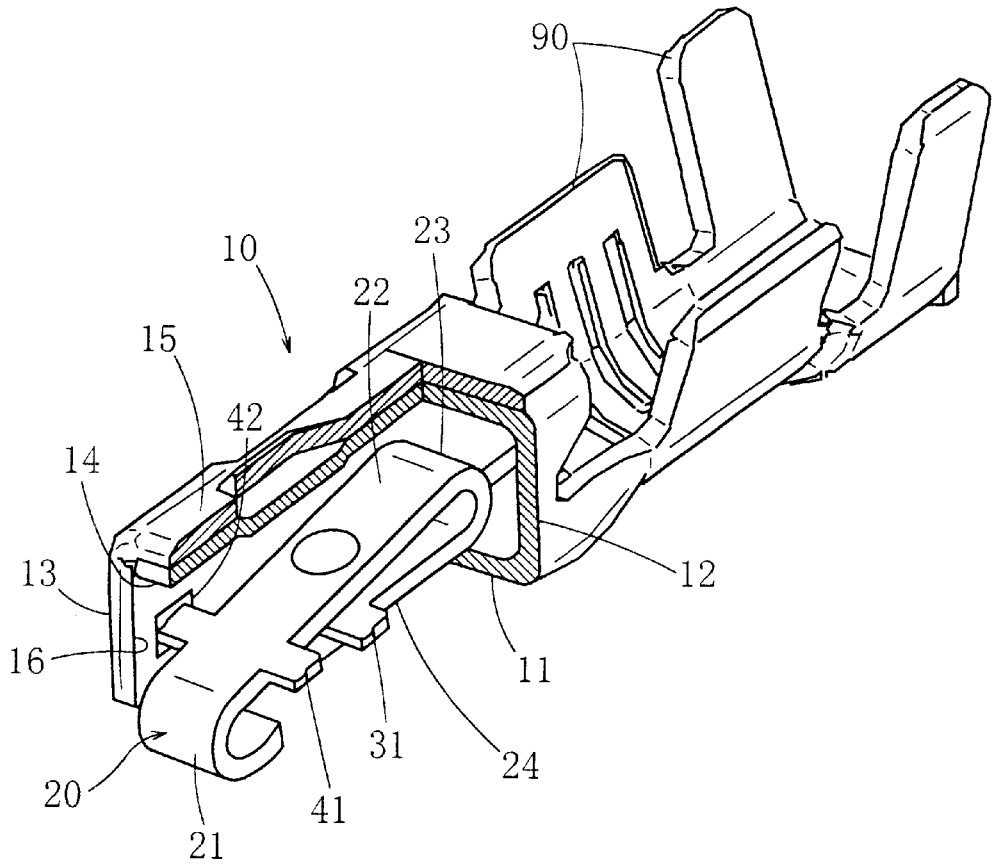
FIG. 2 is a perspective view showing the above-mentioned female terminal by partly cutting away some parts of it.
Figure 3:
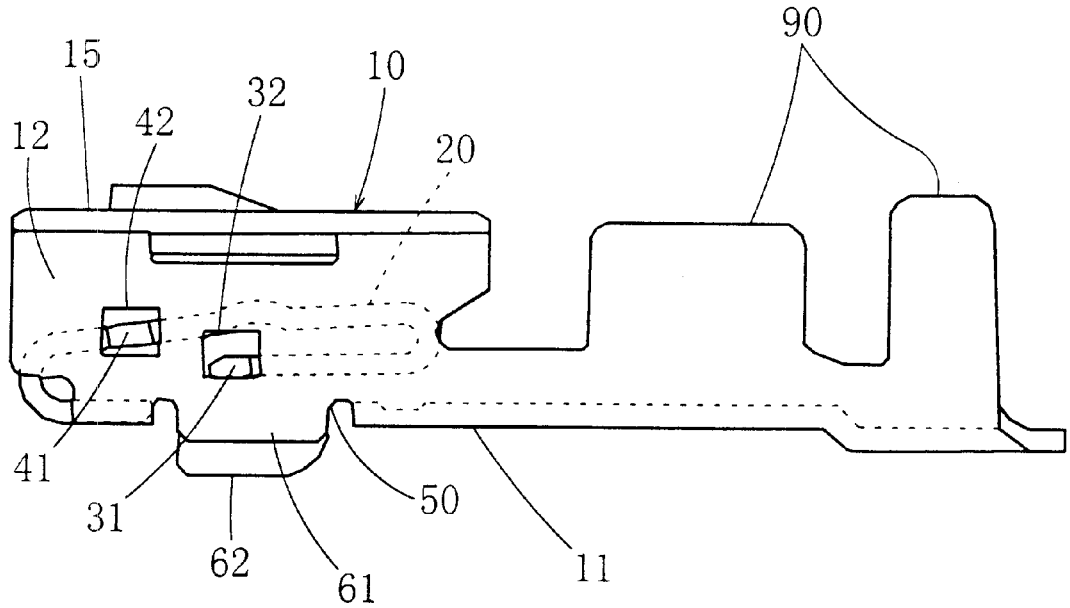
FIG. 3 is a side view of the above-mentioned female terminal.

In the following, some embodiments of the present invention will be described with reference to the attached drawings. FIG. 1 through FIG. 3 show a female terminal of the first embodiment.

This female terminal comprises a tubular body 10, into which a male terminal 70 is inserted through a front opening 16, and a leaf spring 20 that is provided inside the body 10. The body 10 comprises a bottom wall 11, side walls 12, 13 that are provided on both ends of the bottom wall 11 in its width direction to oppose to each other, and upper walls 14, 15 that are provided on the upper sides of the side walls 12, 13 to oppose to the bottom wall 11. The opening 16 is formed at the front end by walls 11 through 15. In the case of this embodiment, the body 10 is formed by folding a sheet of plate. Thus the body 10 has the bottom wall 11, side walls 12, 13 rising from both ends of the bottom wall 11 in the width direction, and upper walls 14, 15 extending sidewise from the upper ends of the side walls 12, 13. The first upper wall 14 extends sidewise from the upper end of one side wall 12, and the second upper wall 15 extends sidewise from the upper end of the other side wall 13 to overlap with the upper wall 14 from above. The present invention is not limited to this embodiment and extensively covers female terminals, which have a tubular body having a bottom wall, side walls and an upper wall. Hence the upper wall may be a single plate without any overlapping. A barrel 90, which is approximately U-shaped when seen in the front-rear direction, is integrally provided on the rear end of the body. This barrel 90 comprises a wire barrel, which is provided on the front side to crimp a core of an electric wire, and an insulation barrel, which is provided on the rear side to crimp the insulator of the wire.

Figure 4:
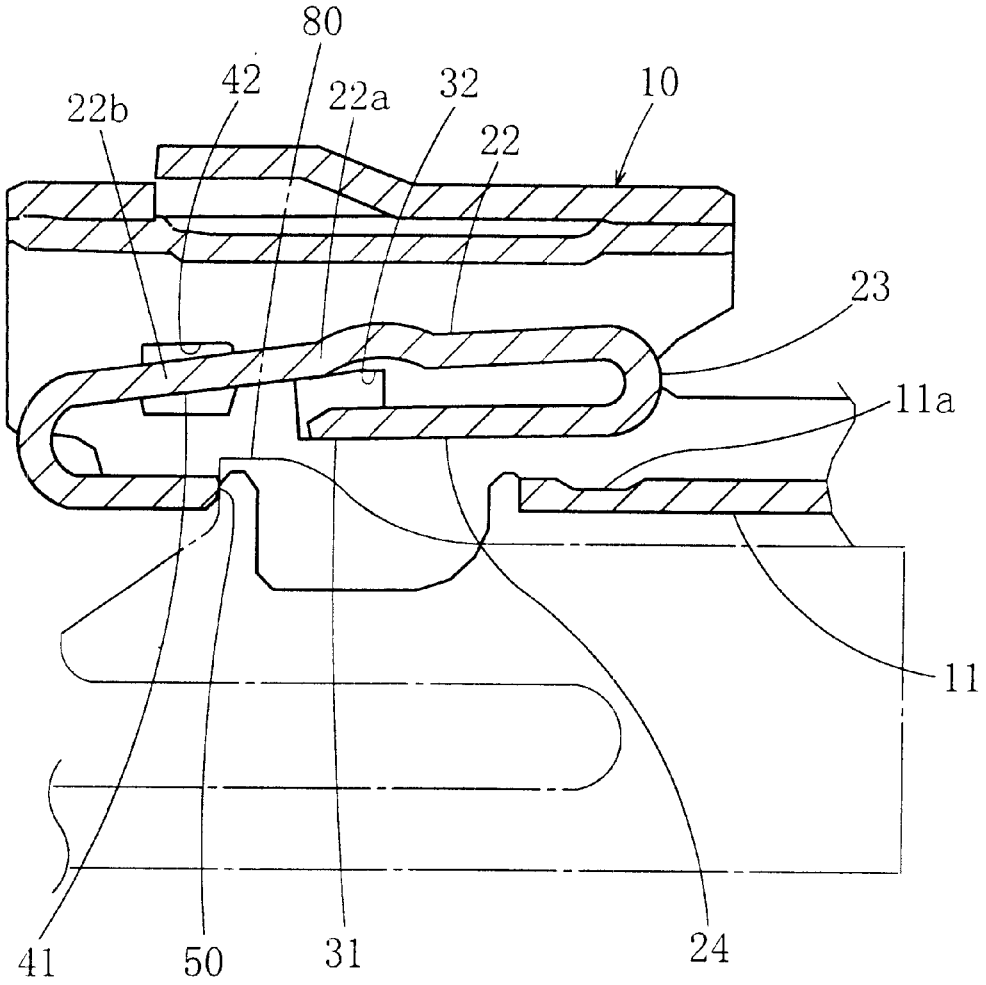
FIG. 4 is a longitudinal sectional view of the body of the above-mentioned female terminal.

As shown in FIG. 2 through FIG. 4, the leaf spring 20 comprises a first bent part 21, which is provided integrally on the front end of the bottom wall 11 of the body 10 to extend upward and rearward, an intermediate part 22, which extends rearward from the first bent part 21, a second bent part 23, which is bent downward and forward from the rear end of the intermediate part 22, and a top end part 24, which extends forward from the second bent part 23 and keeps itself away from the intermediate part 22. Each of the first bent part 21 and the second bent part 23 is formed into an approximately tilted-U when seen from the side. The top end part 24 is located higher than the first bent part 21, and the front end of the top end part 24 is located to the rear of the first bent part 21, and such dimensions are mainly determined by their relationships with a flexible piece 80 of the housing, which will be explained later. Before the insertion of the male terminal 70, there are a gap between the bottom wall 11 and the intermediate part 22 of the body 10 and a gap between the intermediate part 22 and the top end part 24. When needed, a dimple may be made on the intermediate part 22 to define a contact point between the intermediate part 22 and the male terminal 70.

This female terminal is provided with a first fitting means 30, which fits the front end of the top end part 24 of the leaf spring 20 onto the side walls 12, 13. The first fitting means 30 comprises protrusions 31, which protrude in the width direction on both sides of the top end part 24 of the leaf spring 20, and through holes 32, which are formed in the side walls 12, 13 and into which the protrusions 31 are fitted. When the protrusions 31 are received on edges of the through holes 32, the front end of the top end part 24 is fitted onto the side walls 12, 13.

Figure 7:
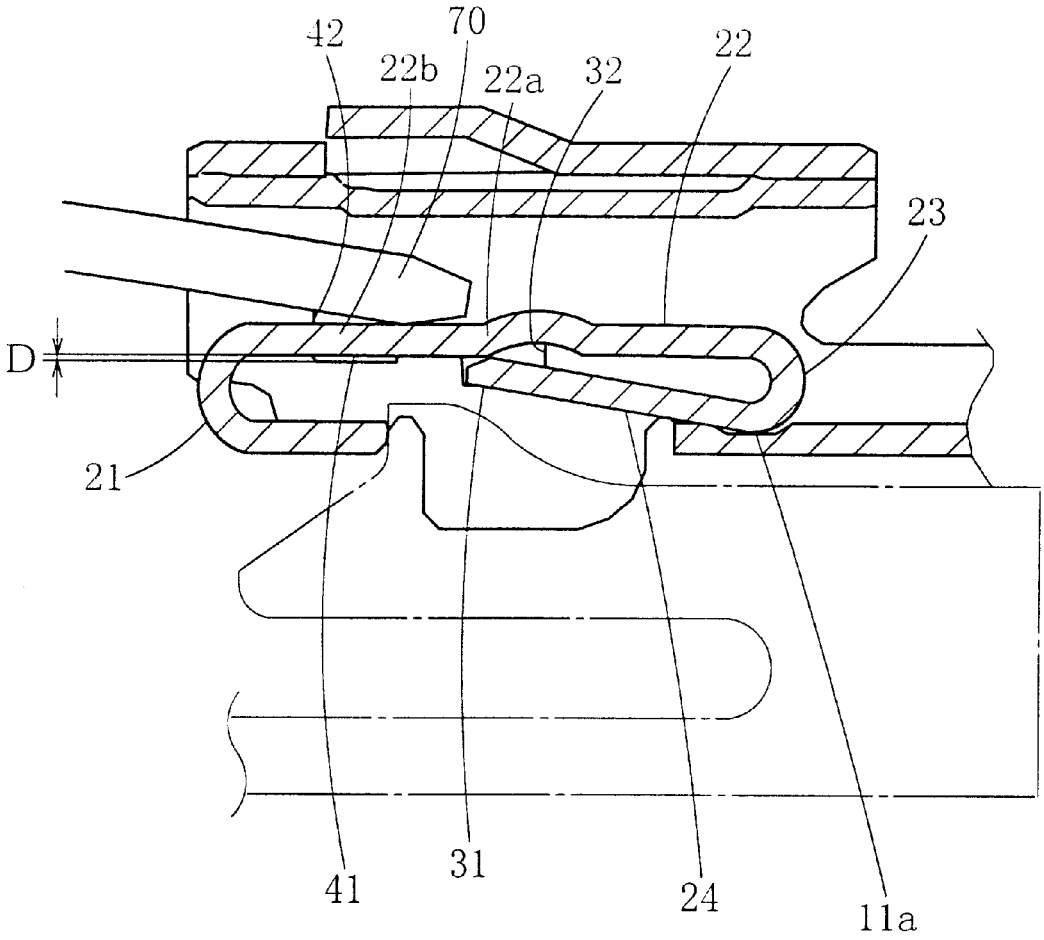
FIG. 7 is a longitudinal sectional view of the body of the above-mentioned female terminal with the male terminal being inserted with a greater tilt than that of the case shown in FIG. 6.

This female terminal is provided with a second fitting means 40, which allows the intermediate part 22 to be displaced downward by a certain length and fits the intermediate part 22 of the leaf spring 20 onto the side walls 12, 13 at the bottom dead point. As shown in FIG. 7, this second fitting means 40 functions when the intermediate part 22 of the leaf spring 20 is displaced downward and contacts the top end part 24 of the leaf spring 20. Under this condition, the second fitting means 40 allows a part 22*b* that is ahead of the above-mentioned contact part 22*a* of the intermediate part 22 of the leaf spring 20 to be displaced downward by a certain length D, and fits the part 22*b* onto the side walls 12, 13 at the bottom dead point. The second fitting means 40 comprises protrusions 41, which protrude in the width direction on both sides of the part 22*b* being ahead of the above-mentioned contact point 22*a* of the intermediate part 22 of the leaf spring 20, and through holes 42, which are formed in the side walls 12, 13 and into which the protrusions 41 fit. The through holes 42 are formed in positions lower than the positions taken by the protrusions 41 when the intermediate part 22 of the leaf spring 20 contacts the top end part 24 of the leaf spring 20 (the state shown in FIG. 7). This arrangement allows the part 22*b*, which is ahead of the above-mentioned contact part 22*a* of the intermediate part 22 of the leaf spring 20, to be displaced downward by a certain length. When a large downward force is exerted to the leaf spring 20, the protrusions 41 will contact the lower edges of the through holes 42, and this will fit the part 22*b* being ahead of the above-mentioned contact part 22*a* of the intermediate part 22 of the leaf spring 20 onto the side walls 12, 13 at the bottom dead point.

When this female terminal is to be fitted in the housing, the cell of the housing is provided with a flexible piece 80, which has flexibility and of which top end can flex in the vertical direction, and this flexible piece 80 is made to fit onto the female terminal. To this end, a flexible-piece-receiving hole 50, into which the flexible piece 80 is to be fitted, is opened in the bottom wall 11. This flexible-piece-receiving hole 50 is formed in the bottom wall 11, ahead of a part at which the second bent part 23 or the rear end of the top end part 24 of the leaf spring 20 is displaced downward to contact the bottom wall 11. In this case, it is preferable to locate the rear edge of the flexible-piece-receiving hole 50 well ahead of the part at which the leaf spring 20 contacts the bottom wall 11. As a result of this, the contact part of the leaf spring 20 will reliably come to the top surface of the bottom wall 11. This will stabilize the angle of contact when the leaf spring 20 contacts and comes to rest on the bottom plate more reliably for each product than the case wherein the leaf spring 20 is arranged to contact and come to rest on the rear edge of the flexible-piece-receiving hole 50. This, in turn, allows easier dimensional control. 61, 62 denote guide pieces, which extend downward from the bottom wall 11 and exhibit a function of guiding the insertion of the female terminal by fitting into guide grooves formed in the housing and a function of preventing reverse insertion of the female terminal. These guide pieces 61, 62 are provided as needed.

The part of the bottom wall 11, to which the second bent part 23 or the rear end of the top end part 24 of the leaf spring 20 is displaced downward and contacts, is formed concavely to provide a concaved part 11*a*.

The method of forming the female terminal is discretionary. In the case of this embodiment, the female terminal is formed from a piece of metal sheet. A plurality of female terminals, which are developed and connected with each other by runners, are blanked out of a piece of metal sheet. Next, respective parts are bent to form the female terminals into the final configuration. Then each female terminal is cut away from the runner.

Figure 5:
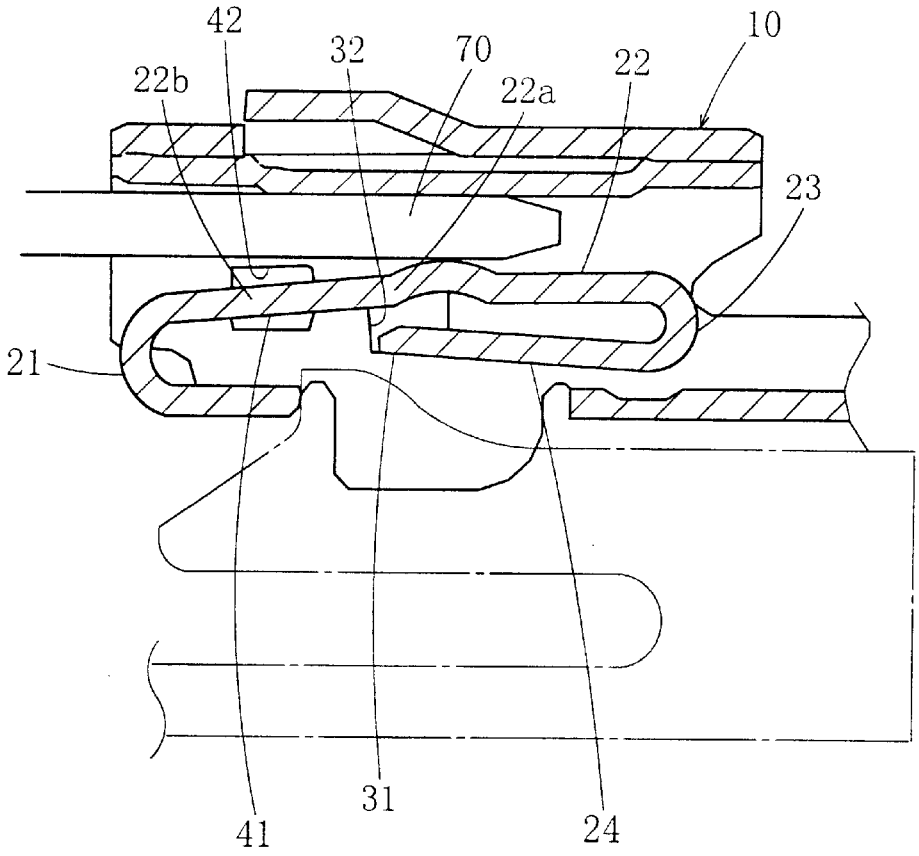
FIG. 5 is a longitudinal sectional view of the body of the above-mentioned female terminal with a male terminal being inserted in a regular position.
Figure 6:
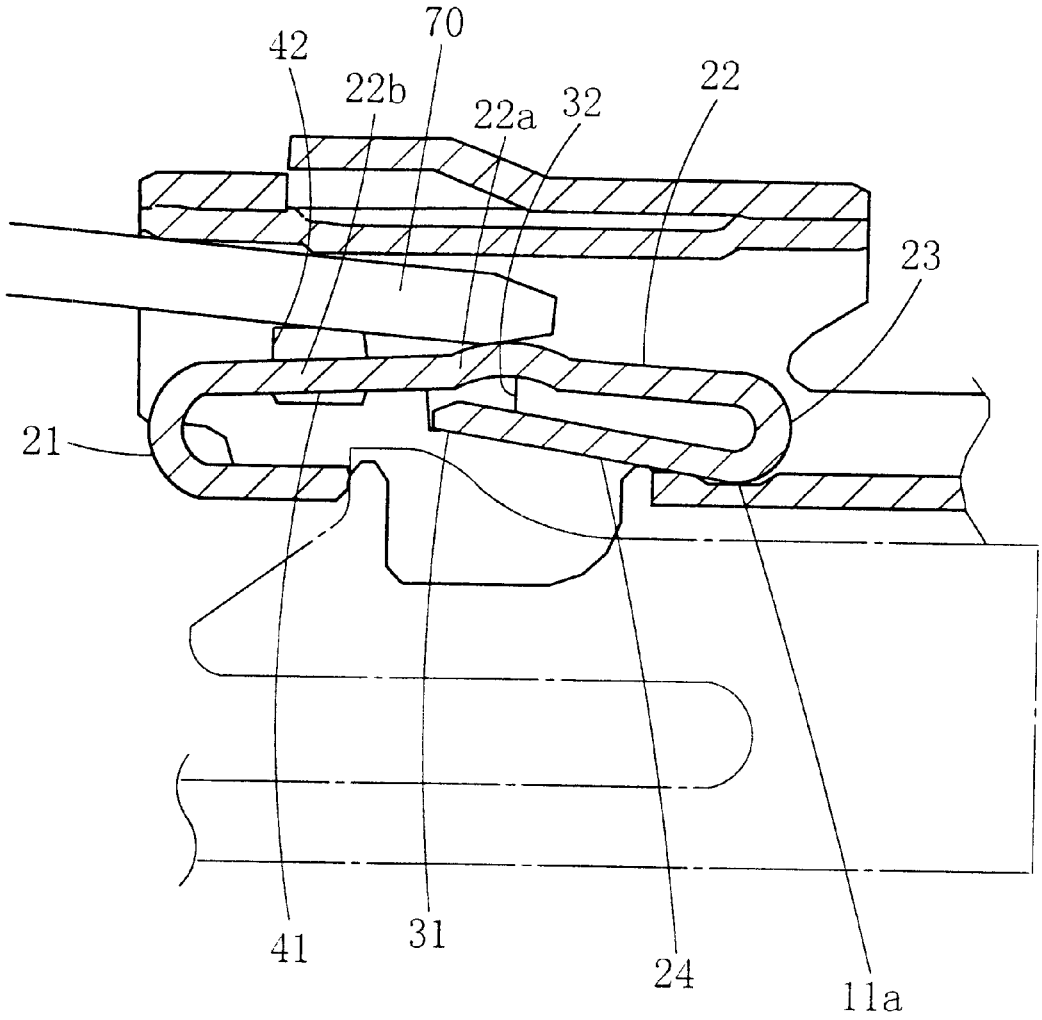
FIG. 6 is a longitudinal sectional view of the body of the above-mentioned female terminal with the male terminal being inserted with a little tilt away from the regular position.
Figure 8:
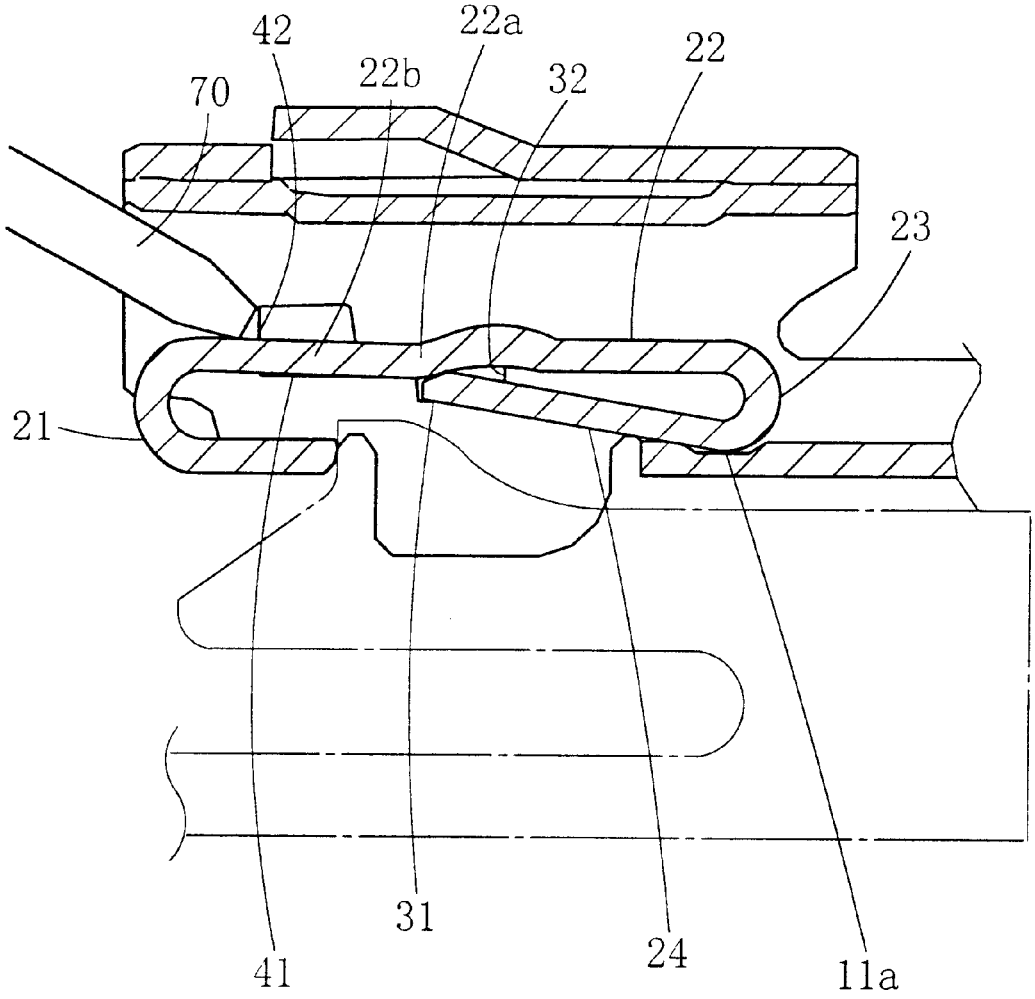
FIG. 8 is a longitudinal sectional view of the body of the above-mentioned female terminal with the male terminal being inserted with a greater tilt than that of the case shown in FIG. 7.

Accordingly, in the case of the female terminal of the present embodiment, when the female terminal is inserted into a cell of the housing, the flexible piece 80 will fit into the flexible-piece-receiving hole 50, and the female terminal will be fitted in the housing. Suppose a male terminal is inserted through the opening 16 at the front of the body 10. As the front end of the top end part 24 of the leaf spring 20 is fitted onto the side walls 12, 13 by the first fitting means 30, when the male terminal 70 is inserted between the upper wall 14 and the leaf spring 20 and comes to its regular position, the leaf spring 20 will exhibit a flexible restoring force for its elastic range between the front end of the top end part 24 and the first bent part 21, providing an adequate contact force between the leaf spring 20 and the male terminal 70 (please refer to FIG. 5). If a prying force or the like acts, the second bent part 23 or the rear end of the top end part 24 of the leaf spring 20 will be displaced downward to contact the bottom wall 11. Then the leaf spring 20 will exhibit an elastic restoring force for its elastic range of only the intermediate part 22 to counteract against the prying force or the like and prevent excessive deformation of the leaf spring 20 (please refer to FIG. 6). If the prying force or the like gets greater, the intermediate part 22 of the leaf spring 20 will be displaced downward to contact the front end of the top end part 24 of the leaf spring 20. As a result, the prying force or the like is countered and the leaf spring 20 is prevented from excessive deformation (please refer to FIG. 7). If the prying force or the like increases much more, the intermediate part 22 of the leaf spring 20 will be displaced downward, and the part 22*b* being ahead of the contact part 22*a* of the intermediate part 22 will be fitted onto the side walls 12, 13 by the second fitting means 40 to rest at the bottom dead point. The prying force or the like is countered by this to prevent excessive deformation of the leaf spring 20 (please refer to FIG. 8). In this way, excessive deformation of the leaf spring 20 can be prevented by countering the prying force or the like in three stages.

In this case, as the front end of the top end part 24 of the leaf spring 20 is fitted onto the side walls 12, 13 by the first fitting means 30, a part of the leaf spring 20 to contact the bottom wall 11 is the second bent part 23 or the rear end of the top end part 24, namely, a part near the rear end of the leaf spring 20. Furthermore, as the intermediate part 22 of the leaf spring 20 is fitted onto the side walls 12, 13 by the second fitting means 40, the rising piece, which was described in relation to the related art, is not required, and in turn, there is no need of securing a part for cutting and raising this piece in the bottom wall 11. With these arrangements, a flexible-piece-receiving hole 50 can be opened in the bottom wall 11 between the first bent part 21 of the leaf spring 20 and the part at which the second bent part 23 or the rear end of the top end part 24 of the leaf spring 20 being displaced downward contacts the bottom wall 11. As a result, operation of disengaging the flexible piece 80 from the female terminal can be done near the front end of the body 10, and as this operation can be visually monitored, the workability is improved. Moreover, as there is a gap beneath the intermediate part 22 of the leaf spring 20 between the first bent part 21 and the front end of the top end part 24, the flexible piece 80 can be accommodated in this gap to keep low the height of the female terminal and compactify the female terminal. Moreover, costs can be reduced through common use of metal molds for this female terminal and a female terminal without any flexible-piece-receiving hole 50 made in the bottom wall 11 thereof. Further, the elimination of the conventional rising pieces results in a more compact development of the female terminal, reduced number of bending processes, a reduced course of production, and improved precision of working.

The first fitting means of the present invention is required to only exhibit a function of fitting the front end of the top end part of the leaf spring onto the side walls. The second fitting means of the present invention is required to only exhibit a function of allowing a part ahead of the contact part of the intermediate part of the leaf spring to be displaced downward by a certain length and fitting that part, at the bottom dead point, onto the side walls. Accordingly, such fitting means can be realized by, for example, forming in the side walls protrusions that protrude inwardly and forming in the leaf spring through holes into which the protrusions fit. In that case, the protrusion is formed by cutting and raising a part of the side, and the through hole is made by holding a side edge of the leaf spring and piercing it. However, as is case of the embodiment above, when protrusions 31, 41 are made to protrude in the width direction on both sides of the leaf spring 20 and through holes 32, 42 are made in the side walls 12, 13 to fit the protrusions 31, 41 into these through holes, they are made by blanking and no bending is required, and in turn, working is easy and dimensional control is easy as well.

The present invention includes an embodiment wherein the part of the bottom wall to which the second bent part or the rear end of the top end part of the leaf spring is displaced downward and contacts is left flat. However, if this part is formed concavely, the height of the body 10 can be reduced by the depth of the concaved part 11*a* and the female terminal can be compactified.

Figure 9:
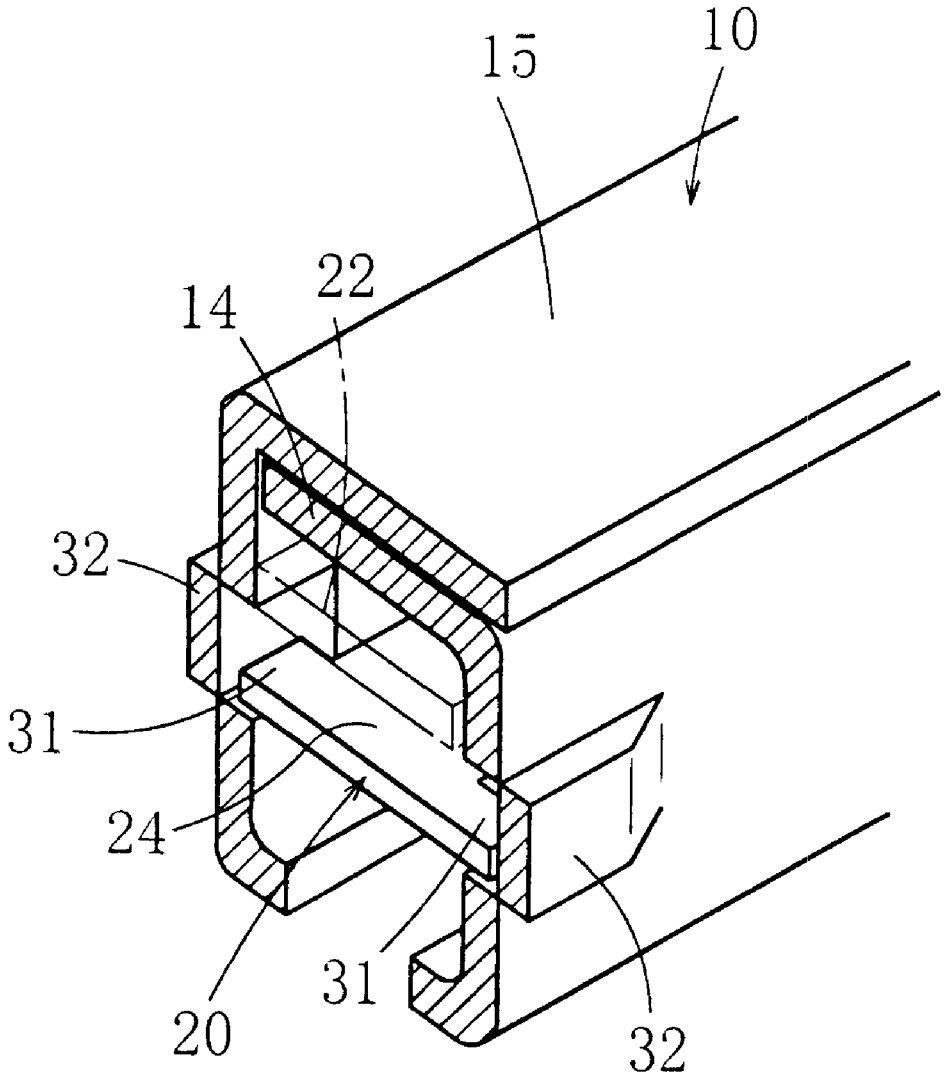
FIG. 9 is a perspective view showing a section of the female terminal of the second embodiment with the intermediate part of the leaf spring being omitted.

FIG. 9 shows a second embodiment. The second embodiment differs from the first embodiment in the structure of fitting the protrusions 31, 41 onto the side walls 12, 13, but the rest of the configuration is the same. Accordingly, the same reference character is given to the same member, and the description of the first embodiment is reiterated here in total. The structure of fitting the protrusions 31, 41 onto the side walls 12, 13 is as described below. The side walls 12, 13 are made to swell outward to form swelled parts 32 into which the protrusions 31 are fitted. These swelled parts 32 are formed by, for example, shearing. The protrusions 31 are fitted into the above-mentioned swelled parts 32. When the protrusions 31 are received by the edges of the swelled parts 32, the front end of the top end part 24 is fitted onto the side walls 12, 13. Although not illustrated, swelled parts 42 into which protrusions 41 are to be fitted are also formed in the side walls 12, 13. These swelled parts 42 are also formed by, for example, shearing. The protrusions 41 are fitted into the above-mentioned swelled parts 42. When the protrusions 41 are received by the edges of the swelled parts 42, the part 22*b* being ahead of the contact part 22*a* of the intermediate part 22 of the leaf spring 20 is fitted onto the side walls 12, 13.

The swelled parts 32 and the swelled parts 42 are shifted in the vertical direction from the center of the height direction.

The actions and effects of the second embodiment are similar to those of the first embodiment. As is the case of the second embodiment, when the protrusions 31, 41 are made to protrude in the width direction on both sides of the leaf spring 20 and the swelled parts 32, 42 into which the protrusions 31, 41 are to be fitted are formed in the side walls 12, 13, they are made by blanking and shearing and bending is not needed, and in turn, working is easy and dimensional control is easy as well.

As is the case of the second embodiment, when the swelled parts 32, 42 are shifted in the vertical direction from the center of the height direction, a function of preventing reverse insertion is exhibited. The cell of the housing is provided with guide grooves extending inwardly on the inner walls of the cell. When the female terminal is to be inserted into the cell of the housing, the swelled parts 32, 42 are made to fit into these guide grooves. If the female terminal is inserted reversely, in other words, if the female terminal being kept upside down is incorrectly inserted into the cell, the swelled parts 32, 42 can not fit into the guide grooves, and the female terminal can not be inserted into the cell; thus reverse insertion is prevented.

The present invention includes all embodiments that combine features of the above-mentioned embodiments.

With the description of these embodiments, the first female terminal that was described in the summary of the invention was fully disclosed. Moreover, with the description of these embodiments, the second female terminal through the fifth female terminal that are shown below were fully described.

The second female terminal is a female terminal as recited in the first female terminal wherein the fitting means comprise protrusions protruding in the width direction on both sides of the leaf spring and through holes being formed in the side walls and into which the protrusions are fitted. With this arrangement, when the protrusions are received by the edges of the through holes, the front end of the top end part of the leaf spring or a part ahead of the above-mentioned contact part of the intermediate part of the leaf spring is fitted onto the side walls. Accordingly, as the fitting means can be formed by, for example, blanking, working is easy and dimensional control is also easy.

The third female terminal is a female terminal as recited in the first female terminal or the second female terminal, wherein the fitting means comprise protrusions protruding in the width direction on both sides of the leaf spring and swelled parts being formed in the side walls to swell outward and into which the protrusions are fitted. With this arrangement, when the protrusions are received by the inner walls of the swelled parts, the front end of the top end part of the leaf spring or a part ahead of the above-mentioned contact part of the intermediate part of the leaf spring is fitted onto the side walls. Accordingly, as the fitting means can be formed by, for example, shearing, the working is easy and the dimensional control is also easy.

The fourth female terminal is a female terminal as recited in the third female terminal wherein the swelled parts are shifted in the vertical direction from the center of the height direction. With this arrangement, the function of preventing reverse insertion is exhibited. The cell of the housing is provided with guide grooves extending inwardly on the inner walls of the cell. When the female terminal is to be inserted into the cell of the housing, the swelled parts are made to fit into these guide grooves. If the female terminal is inserted reversely, in other words, if the female terminal being kept upside down is incorrectly inserted into the cell, the swelled parts can not fit into the guide grooves, and the female terminal can not be inserted into the cell; thus reverse insertion is prevented. The swelled parts can perform the function of preventing reverse insertion.

The fifth female terminal is a female terminal as recited in any one of the first female terminal through the fourth female terminal wherein a part of the bottom wall to which the second bent part or the rear end of the top end part of the leaf spring is displaced downward and contacts is formed concavely. With this arrangement, the height of the body can be reduced by the depth of the concaved part, and the female terminal can be compactified.

What is claimed is:

1. A female terminal comprising a tubular body having a bottom wall, side walls provided on both ends of the bottom wall in the width direction to oppose to each other and an upper wall provided on the upper side of the side wall to oppose to the bottom wall, into which a male terminal is inserted through a front opening thereof, a leaf spring being provided inside the body and having a first bent part being integrally provided on the front end of the bottom wall of the body and being bent upward and rearward, an intermediate part extending rearward from the first bent part, a second bent part being bent downward and forward from the rear end of the intermediate part, and a top end part extending forward from the bottom of the second bent part and keeping itself away from the intermediate part, a first fitting means for fitting the front end of the top end part of the leaf spring onto the side walls elevated above the bottom wall, a second fitting means, which allows, when the intermediate part of the leaf spring is displaced downward to contact a contacting part of the top end part of the leaf spring, a supported part ahead of said contacting part of the intermediate part of the leaf spring to be displaced downward by a certain length, and fits the supported part onto the side walls at a bottom dead point of the downward displacement, and a flexible-piece-receiving hole being opened in the bottom wall ahead of a part at which the second bent part or the rear end of the top end part of the leaf spring being displaced downward contacts the bottom wall.

2. A female terminal as recited in claim 1 wherein a part of the bottom wall to which the second bent part or the rear end of the top end part of the leaf spring is displaced downward and contacts is formed concavely.

3. A female terminal as recited in claim 1 wherein the fitting means comprise protrusions protruding in the width direction on both sides of the leaf spring and swelled parts being formed in the side walls to swell outward and in which the protrusions are fitted.

4. A female terminal as recited in claim 3 wherein a part of the bottom wall to which the second bent part or the rear end of the top end part of the leaf spring is displaced downward and contacts is formed concavely.

5. A female terminal as recited in claim 3 wherein the swelled parts are shifted in the vertical direction from the center of the height direction.

6. A female terminal as recited in claim 5 wherein a part of the bottom wall to which the second bent part or the rear end of the top end part of the leaf spring is displaced downward and contacts is formed concavely.

7. A female terminal as recited in claim 1 wherein the fitting means comprise protrusions protruding in the width direction on both sides of the leaf spring and through holes being formed in side walls and into which the protrusions are fitted.

8. A female terminal as recited in claim 7 wherein a part of the bottom wall to which the second bent part or the rear end of the top end part of the leaf spring is displaced downward and contacts is formed concavely.

9. A female terminal as recited in claim 7 wherein the fitting means comprise protrusions protruding in the width direction on both sides of the leaf spring and swelled parts being formed in the side walls to swell outward and in which the protrusions are fitted.

10. A female terminal as recited in claim 9 wherein a part of the bottom wall to which the second bent part or the rear end of the top end part of the leaf spring is displaced downward and contacts is formed concavely.

11. A female terminal as recited in claim 9 wherein the swelled parts are shifted in the vertical direction from the center of the height direction.

12. A female terminal as recited in claim 11 wherein a part of the bottom wall to which the second bent part or the rear end of the top end part of the leaf spring is displaced downward and contacts is formed concavely.

13. A female electrical terminal comprising:

an electrically conductive tubular body including a bottom wall, an upper wall spaced above said bottom wall, and two side walls spaced laterally from each other and respectively extending between said bottom wall and said upper wall, wherein a terminal cavity is formed within said tubular body between said bottom wall, said upper wall and said side walls, with an opening into said terminal cavity bounded by respective front ends of said bottom wall, said upper wall, and said two side walls; and an electrically conductive spring element, which is arranged in said terminal cavity, and which includes a first bent part extending from said front end of said bottom wall and bending in a U-shape into said terminal cavity away from said opening, an intermediate part integrally extending from said first bent part in said cavity away from said opening, a second bent part integrally extending from said intermediate part and bending in a U-shape toward said opening, and an end part that integrally extends from said second bent part toward said opening at a location between said intermediate part and said bottom wall and spaced apart from said intermediate part, and that terminates at a free end located between said intermediate part and said bottom wall and spaced apart from said bottom wall;

wherein:

said side walls include a first support portion and said free end includes a first support portion that cooperate to form a first support arrangement that supports said free end relative to said side walls at a supported height between said intermediate part and said bottom wall and spaced apart from said bottom wall;

said side walls include a second support portion and said intermediate part includes a second support portion that cooperate to form a second support arrangement that supports said intermediate part relative to said side walls with a vertical play range and a supported bottom travel limit; and said second support arrangement is located closer to said opening than are said first support arrangement and said free end.

14. The female electrical terminal according to claim 13, wherein said supported bottom travel limit of said second support arrangement is elevated higher above said bottom wall than is said supported height of said first support arrangement.

15. The female electrical terminal according to claim 13, wherein said spring element, said first support arrangement and said second support arrangement are configured and arranged so that:

when said spring element is in repose and in a first deflection stage of being deflected toward said bottom wall, said end part and said second bent part are spaced away from said bottom wall, said free end is supported at said supported height by said first support arrangement, said intermediate part is spaced apart from said free end and said end part, and said second support portion of said intermediate part is in said vertical play range of said second support arrangement;

when said spring element is deflected toward said bottom wall to an end of said first deflection stage and into a second deflection stage, at least one of said end part and said second bent part come into contact with said bottom wall, said free end is supported at said supported height by said first support arrangement, said intermediate part is spaced apart from said free end and said end part, and said second support portion of said intermediate part is in said vertical play range of said second support arrangement;

when said spring element is deflected toward said bottom wall to an end of said second deflection stage and into a third deflection stage, said at least one of said end part and said second bent part remain in contact with said bottom wall, said free end is supported at said supported height by said first support arrangement, said intermediate part comes into contact with at least one of said free end and said end part, and said second support portion of said intermediate part is in said vertical play range of said second support arrangement; and when said spring element is deflected toward said bottom wall to an end of said third deflection stage, said at least one of said end part and said second bent part remain in contact with said bottom wall, said free end is supported at said supported height by said first support arrangement, said intermediate part remains in contact with said at least one of said free end and said end part, and said second support portion of said intermediate portion comes to said supported bottom travel limit of said second support arrangement so as to support said intermediate part at said bottom travel limit.

16. The female electrical terminal according to claim 13, wherein said first support portion of said side walls comprises an opening or recess in at least one of said side walls, and said first support portion of said free end comprises at least one protrusion protruding laterally from said end part into said opening or recess.

17. The female electrical terminal according to claim 13, wherein said second support portion of said side walls comprises an opening or recess in at least one of said side walls, and said second support portion of said intermediate part comprises at least one protrusion protruding laterally from said intermediate part into said opening or recess.

18. The female electrical terminal according to claim 13, wherein said bottom wall has a hole therein adapted to receive a flexible protrusion of an outer insulating housing, said hole is located between said first bent part and said second bent part, and said free end and said first support arrangement are located above said hole and between said hole and said intermediate part.

19. The female electrical terminal according to claim 13, wherein said free end is located closer to said opening of said cavity than is a center of a length of said intermediate part.

* * * * *